US009131570B2

(12) United States Patent
Onishi et al.

(10) Patent No.: US 9,131,570 B2
(45) Date of Patent: Sep. 8, 2015

(54) LIGHTING DEVICE AND LUMINAIRE

(71) Applicant: Panasonic Intellectual Property Management Co., Ltd., Osaka (JP)

(72) Inventors: Hisanaga Onishi, Hyogo (JP); Nobuo Ukita, Hyogo (JP); Katsuyoshi Nakada, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 0 days.

(21) Appl. No.: 14/399,482

(22) PCT Filed: May 27, 2013

(86) PCT No.: PCT/JP2013/003321

§ 371 (c)(1),
(2) Date: Nov. 6, 2014

(87) PCT Pub. No.: WO2013/186998

PCT Pub. Date: Dec. 19, 2013

(65) Prior Publication Data

US 2015/0123556 A1 May 7, 2015

(30) Foreign Application Priority Data

Jun. 15, 2012 (JP) ..... 2012-136173

(51) Int. Cl.
*H05B 33/08* (2006.01)
*H05B 37/02* (2006.01)

(52) U.S. Cl.
CPC ..... *H05B 33/0818* (2013.01); *H05B 33/0815* (2013.01); *H05B 33/0845* (2013.01); *H05B 33/0851* (2013.01); *H05B 37/02* (2013.01)

(58) Field of Classification Search
None
See application file for complete search history.

(56) References Cited

U.S. PATENT DOCUMENTS

2003/0006710 A1* 1/2003 Black et al. ..... 315/138
2009/0315470 A1* 12/2009 Kumagai et al. ..... 315/224

(Continued)

FOREIGN PATENT DOCUMENTS

JP 2004-273267 A 9/2004
JP 2006-222376 A 8/2006

(Continued)

OTHER PUBLICATIONS

International Search Report for corresponding International Application No. PCT/JP2013/003321 mailed Sep. 3, 2013.

(Continued)

*Primary Examiner* — Crystal L Hammond
(74) *Attorney, Agent, or Firm* — Renner, Otto, Boisselle & Sklar, LLP

(57) ABSTRACT

A lighting device includes a switching regulator having an inductor and a switching device, and a controller. The controller includes a peak current detector that outputs a peak detection signal when detecting that a current flowing through the switching device reaches a threshold, a zero-cross detector that outputs a zero-cross detection signal when a current discharged from the inductor reaches a predetermined lower limit value or less, a synchronization signal controller that outputs a periodic synchronization signal, and a switching controller. The switching controller turns on the switching device in synchronization with a start of an on-period of the synchronization signal and the zero-cross detection signal, and turns off the switching device in synchronization with the peak detection signal. The peak current detector reduces the threshold when an on-period of the synchronization signal finishes, and increases the threshold to an original value when an on-period of the synchronization signal starts.

4 Claims, 5 Drawing Sheets

(56) References Cited

U.S. PATENT DOCUMENTS

| | | | | |
|---|---|---|---|---|
| 2010/0219764 | A1 | 9/2010 | Yamasaki et al. | |
| 2010/0308733 | A1* | 12/2010 | Shao | 315/119 |
| 2011/0140620 | A1 | 6/2011 | Lin et al. | |
| 2012/0169243 | A1 | 7/2012 | Lin et al. | |
| 2012/0242235 | A1 | 9/2012 | Naruo et al. | |
| 2012/0242246 | A1 | 9/2012 | Naruo | |
| 2012/0286696 | A1* | 11/2012 | Ghanem | 315/291 |

FOREIGN PATENT DOCUMENTS

| | | | |
|---|---|---|---|
| JP | 2009-238520 | A | 10/2009 |
| JP | 2010-040400 | A | 2/2010 |
| JP | 2011-108671 | A | 6/2011 |
| JP | 2012-023010 | A | 2/2012 |
| JP | 2012-033611 | A | 2/2012 |
| JP | 2012-064503 | A | 3/2012 |
| JP | 2012-199392 | A | 10/2012 |
| JP | 2012-204360 | A | 10/2012 |

OTHER PUBLICATIONS

Form PCT/ISA/237 for corresponding International Application No. PCT/JP2013/003321 dated Sep. 3, 2013.

* cited by examiner

LIGHTING DEVICE AND LUMINAIRE

TECHNICAL FIELD

The invention relates to a lighting device configured to light a light source formed of a solid-state light emitting device, and a luminaire including the lighting device.

BACKGROUND ART

In recent years, lighting devices and luminaires adapted for solid-state light emitting devices as a light source, instead of an incandescent lamp or a fluorescent lamp, have been rapidly widespread. Examples of the solid-state light emitting devices include a light emitting diode and an organic electroluminescence (EL) device. For example, JP2011-108671A (hereinafter, referred to as Document 1) discloses a lighting device (an LED dimming device) which is adapted for light emitting diodes (LEDs) as a light source and is configured to control (to dim) the light intensity of the LEDs in accordance with a dimming signal supplied from a dimming level designator.

Incidentally, examples of schemes for dimming LEDs include: a dimming scheme by which LEDs are continuously supplied with a current and magnitude of the supplied current is changed (hereinafter, referred to as "a DC dimming scheme"); and a scheme by which a current supply to LEDs is periodically switched on and off and a ratio of a current supply period (on-duty ratio) is changed (hereinafter, referred to as "a burst dimming scheme"). The examples also includes a scheme which performs the DC dimming scheme when the dimming level is comparatively high (bright) and performs the burst dimming scheme when the dimming level is comparatively low (dark), as the conventional example described in Document 1.

Incidentally, a switching regulator is typically employed as a lighting circuit for lighting the LEDs. In the burst dimming scheme, the current supply period in which the switching regulator performs a switching operation thereof decreases in accordance with decrease in the dimming level. Thus, decrease in the dimming level will increase fluctuation in the number of switching operation performed by the switching regulator in current supply periods. Therefore, there is a problem in that the fluctuation of the light intensity increases in accordance with the decrease in the dimming level.

SUMMARY OF INVENTION

The invention is developed in view of the above problem, and an object thereof is to perform dimming control at a low dimming level while the fluctuation in the light intensity is suppressed.

A lighting device of the invention includes: a power converter configured to convert an input power into a DC power required for a light source unit as a load, the light source unit comprising a solid-state light emitting device as a light source; and a controller configured to control the power converter such that the light source unit is supplied with the DC power of which value is adjusted to a value corresponding to a dimming level designated from an outside. The power converter is formed of a switching regulator that includes: a smoothing capacitor configured to be connected in parallel to the light source unit; an inductor connected in series to the smoothing capacitor; and a switching device configured to alternately switch between a state of magnetic energy being accumulated in the inductor by a current flowing through the inductor and a state of the magnetic energy accumulated in the inductor being discharged as a current. The controller includes: a peak current detector configured to output a peak detection signal when detecting that a detection value of the current flowing through the switching device reaches a threshold while the switching device is turned on; a zero-cross detector configured to output a zero-cross detection signal when a value of the current discharged from the inductor reaches a predetermined lower limit value or less; a synchronization signal controller configured to output a synchronization signal having a period and an on-time period in accordance with the dimming level; and a switching controller configured to start performing switching of the switching device in synchronization with rising edges of the synchronization signal, and to stop performing the switching of the switching device in synchronization with falling edges of the synchronization signal. The switching controller is configured to turn on the switching device in synchronization with the rising edges of the synchronization signal and the zero-cross detection signal, and to turn off the switching device in synchronization with the peak detection signal. The peak current detector is configured to reduce the threshold while the synchronization signal is low, and to increase the threshold so as to be an original value while the synchronization signal is high.

In an embodiment, the peak current detector is configured to relatively reduce and increase the threshold by increasing and decreasing the detection value.

A luminaire of the invention includes: any one of the above lighting devices, the light source unit comprising the solid-state light emitting device as the light source; and a luminaire body that holds the light source unit and the lighting device.

According to the lighting device and the luminaire of the invention, even when an on-period of the synchronization signal finishes while the switching device is turned on, the off-timing of the switching device can be advanced since the threshold is reduced, in comparison with a case where the threshold is fixed. Accordingly, it is possible to perform dimming control at a low dimming level while the fluctuation in the light intensity is suppressed.

DESCRIPTION OF EMBODIMENTS

A lighting device in an embodiment with the technical feature of the invention is now explained. The lighting device is adapted for a light emitting diode as a light source. Examples of solid-state light emitting device to be lighted by the lighting device of the invention are not limited to a light emitting diode, and include other solid-state light emitting diodes such as an organic EL device.

Figure 1:
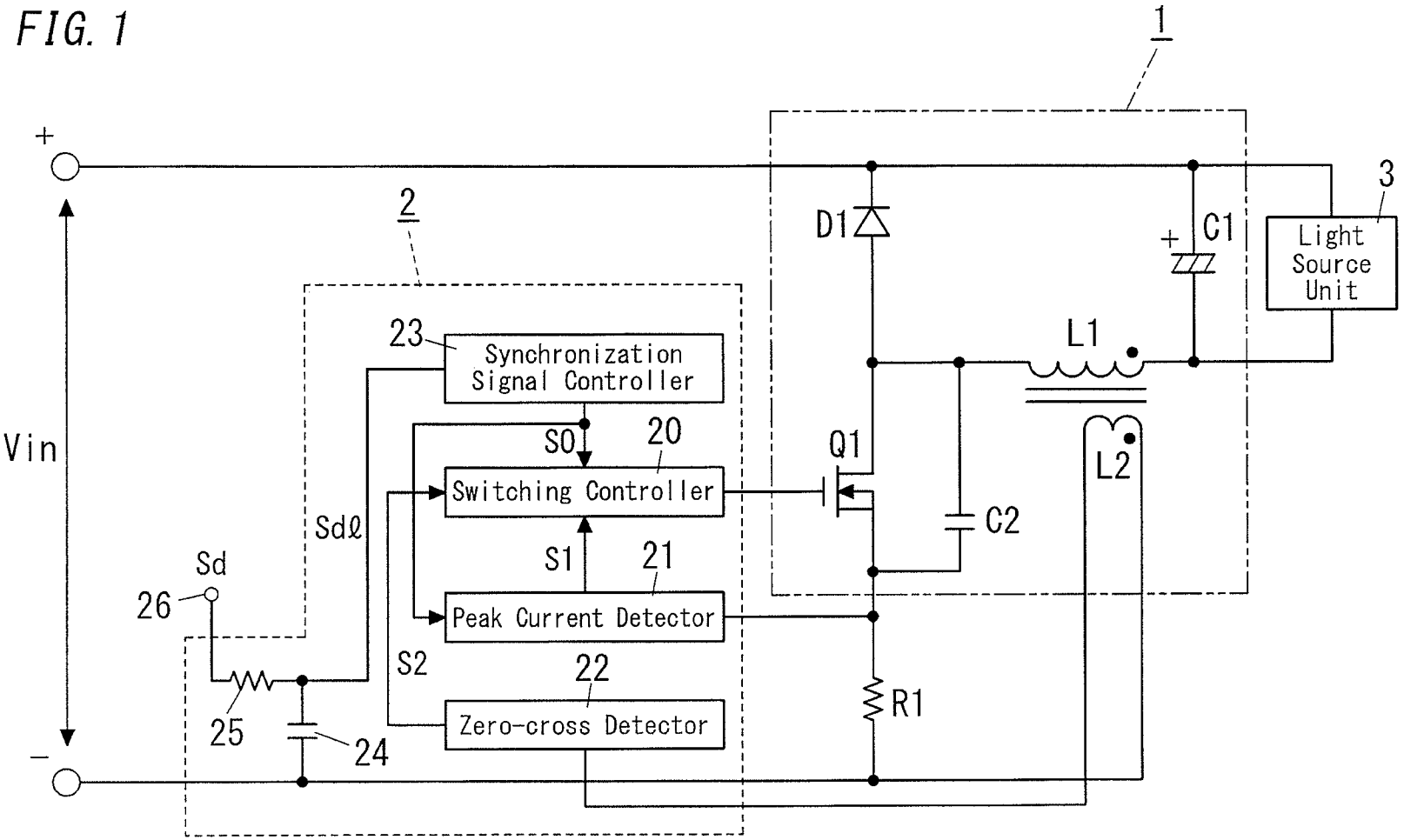
FIG. 1 is a circuit diagram of a lighting device according to an embodiment of the invention.

As shown in FIG. 1, the lighting device of the embodiment includes a power converter 1 configured to step-down (convert) a DC (direct-current) input voltage Vin into a voltage allowed to be applied to a light source unit 3, and a controller 2 configured to control the power converter 1. The light source unit 3 is formed of a series circuit of two or more light emitting diodes (not shown) or a circuit in which series circuits of two or more light emitting diodes are connected in parallel (not shown). The rated voltage of the light source unit 3 corresponds to a value obtained by multiplying a forward voltage of a light emitting diode by the number of light emitting diodes connected in series.

The power converter 1 is formed of a non-isolated type buck converter, which is a known device, and is configured to convert an input power and to output the converted power to the light source unit 3 as a load. The power converter 1 includes a switching device Q1 which is a field-effect-transistor, an inductor L1, a diode D1, a smoothing capacitor C1, a capacitor C2 and so on. A drain of the switching device Q1 is connected to an anode of the diode D1, a first end of the inductor L1, and a first end of the capacitor C2. A source of the switching device Q1 is connected to a second end of the capacitor C2 and a first end of a detection resistor R1. A second end of the inductor L1 is connected to a negative potential side end of the smoothing capacitor C1 and a first end of the light source unit 3 (i.e., a cathode of a light emitting diode). A cathode of the diode D1 is connected to a positive potential side end of the smoothing capacitor C1 and a second end of the light source unit 3 (i.e., an anode of a light emitting diode). The input voltage Vin is applied between the cathode of the diode D1 and a second end of the detection resistor R1. A detection winding L2 is magnetically coupled to the inductor L1 in order to detect a current discharged from the inductor L1 during an off-period of the switching device (hereinafter, referred to as "an inductor current"). The illustrated circuit structure of the power converter 1 is one example, and the power converter 1 may have another switching regulator circuit structure so long as it can step-down an input voltage Vin into a rated voltage of the light source unit 3 or less.

The controller 2 includes a switching controller 20, a peak current detector 21, a zero-cross detector 22, a synchronization signal controller 23, a capacitor 24, a resistor 25, an input terminal 26, and so on.

The peak current detector 21 is configured to detect a current (a peak current) flowing through the switching device Q1 indirectly, by detecting a voltage V(R1) across the detection resistor R1, and to compare the detected voltage V(R1), which is proportional to the current flowing through the switching device Q1, with a threshold Vth. The peak current detector 21 is also configured to output a peak detection signal S1 to the switching controller 20 when the detected voltage V(R1) reaches the threshold Vth (i.e., when detecting that the detected voltage V(R1) increases to the threshold Vth). In other words, the peak current detector 21 is configured to output the peak detection signal 51 when detecting that a detection value of the current flowing through the switching device Q1 reaches the threshold.

The zero-cross detector 22 is configured to detect the inductor current indirectly through a voltage Vsub across the detection winding L2. The zero-cross detector 22 is also configured to output a zero-cross detection signal S2 to the switching controller 20 when a value of the inductor current reaches a lower limit value or less (i.e., when detecting that the inductor current decreases to the lower limit value or less).

The input terminal 26 is configured to be supplied, from an outside, with a dimming signal Sd that designates a dimming level of the light source unit 3. The dimming signal Sd, which is supplied from the outside (through the input terminal 26) and has a form of a PWM signal, is to be integrated by an integration circuit formed of the capacitor 24 and the resistor 25, and as a result a DC voltage signal (a dimming level signal Sdl) having a voltage corresponding to an on-duty ratio of the dimming signal Sd is supplied to the synchronization signal controller 23. The dimming signal Sd is formed of a periodic square pulse signal of which the on-duty ratio decreases in accordance with decrease in the dimming level (decrease in the light intensity). Note that the dimming level represents an average value of a current flowing in the light source unit 3, where 100% of the dimming level is defined as the current value when the light source unit 3 is continuously supplied with the rated current to be lighted at the rated lighting state.

The synchronization signal controller 23 is configured to output, to the switching controller 20 and the peak current detector 21, a synchronization signal S0 (see FIG. 2) which is formed of a periodic square pulse signal and of which an on-period (on-time period) Ton is proportional to the voltage of the DC voltage signal.

The switching controller 20 is configured to start performing switching of the switching device Q1 in synchronization with each rising edge of the synchronization signal S0, and to stop performing the switching of the switching device Q1 in synchronization with each falling edge of the synchronization signal S0. Thus, the switching controller 20 performs the switching of the switching device Q1 during each on-period (from a rising edge to a falling edge) Ton of the switching signal S0, and does not perform the switching of the switching device Q1 during each off-period (from a falling edge to a rising edge) Toff of the switching signal S0. The switching controller 20 is also configured, during each on-period Ton, to turn on the switching device Q1 in synchronization with a rising edge of the synchronization signal S0 and the zero-cross detection signal S2 (a rising edge of the zero-cross detection signal S2), and to turn off the switching device Q1 in synchronization with the peak detection signal S1. (a rising edge of the peak detection signal S1) (see FIG. 2). As a result, as shown in FIG. 2, the inductor L1 is supplied with a current I(L1) of which waveform is like a triangle-wave, and the light source unit 3 as a load is supplied with a current (an output current) which is obtained by rectifying, by the smoothing capacitor C1, the current I(L1) flowing through the inductor L1.

Figure 4:
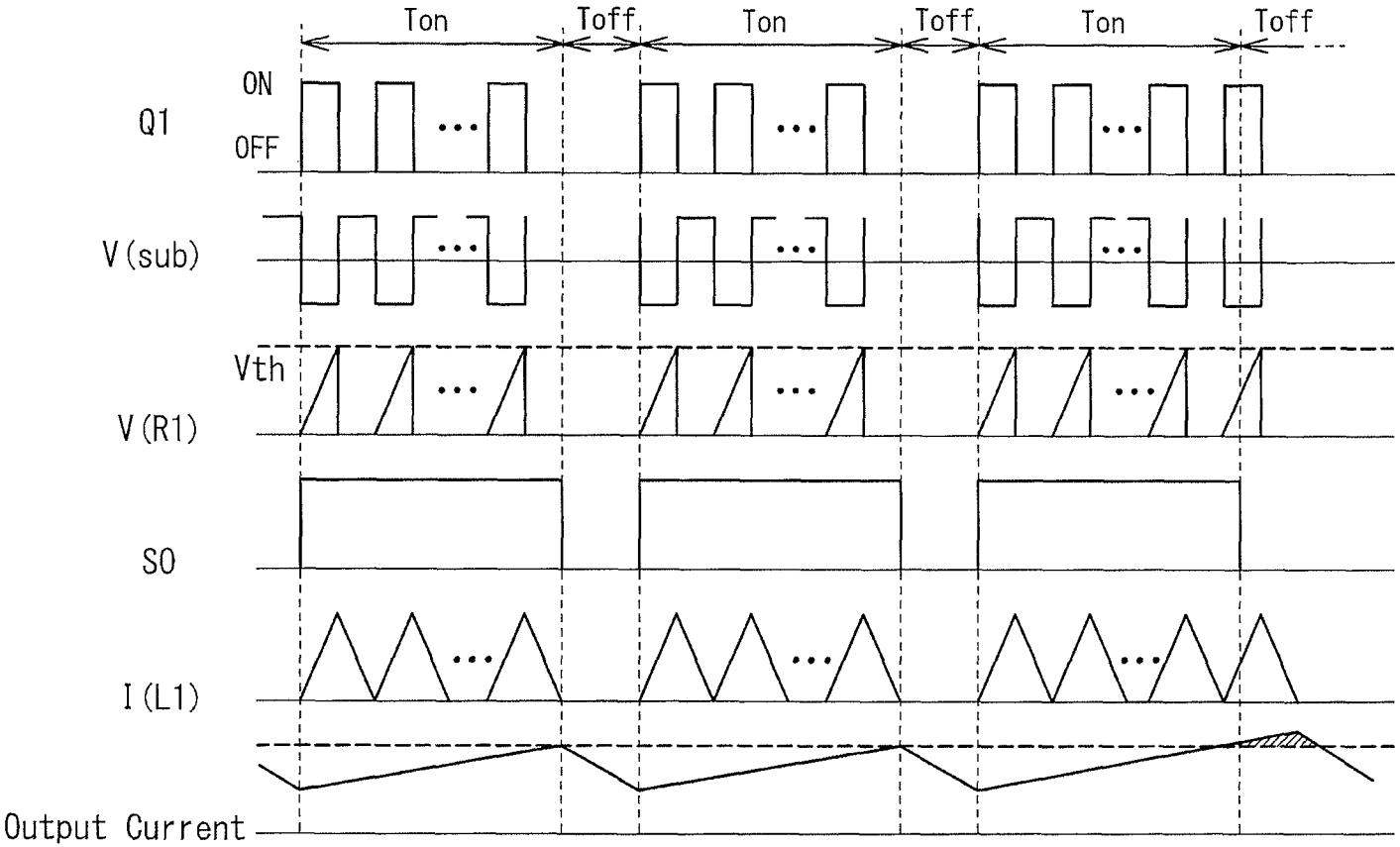
FIG. 4 is a comparative timing chart.

The switching controller 20 is configured to be prohibited from turning on the switching device Q1 even if receiving a zero-cross detection signal S2, if an on-period Ton finishes (if a synchronization signal S0 falls) between a point in time when the switching device Q1 is turned off and a point in time when the zero-cross detection signal S2 is supplied therewith. However, if an on-period Ton of the synchronization signal S0 finishes when the switching device Q1 is in ON-state, a current will keep flowing until the switching device Q1 is turned off by the switching controller 20 and the accumulated magnetic energy in the inductor L1 is fully discharged (see FIG. 4). This causes a fluctuation in amount of DC power supplied to the light source unit 3 per one period of the synchronization signal S0, resulting in occurring a flicker of the light source unit 3 due to increased light intensity.

Figure 2:
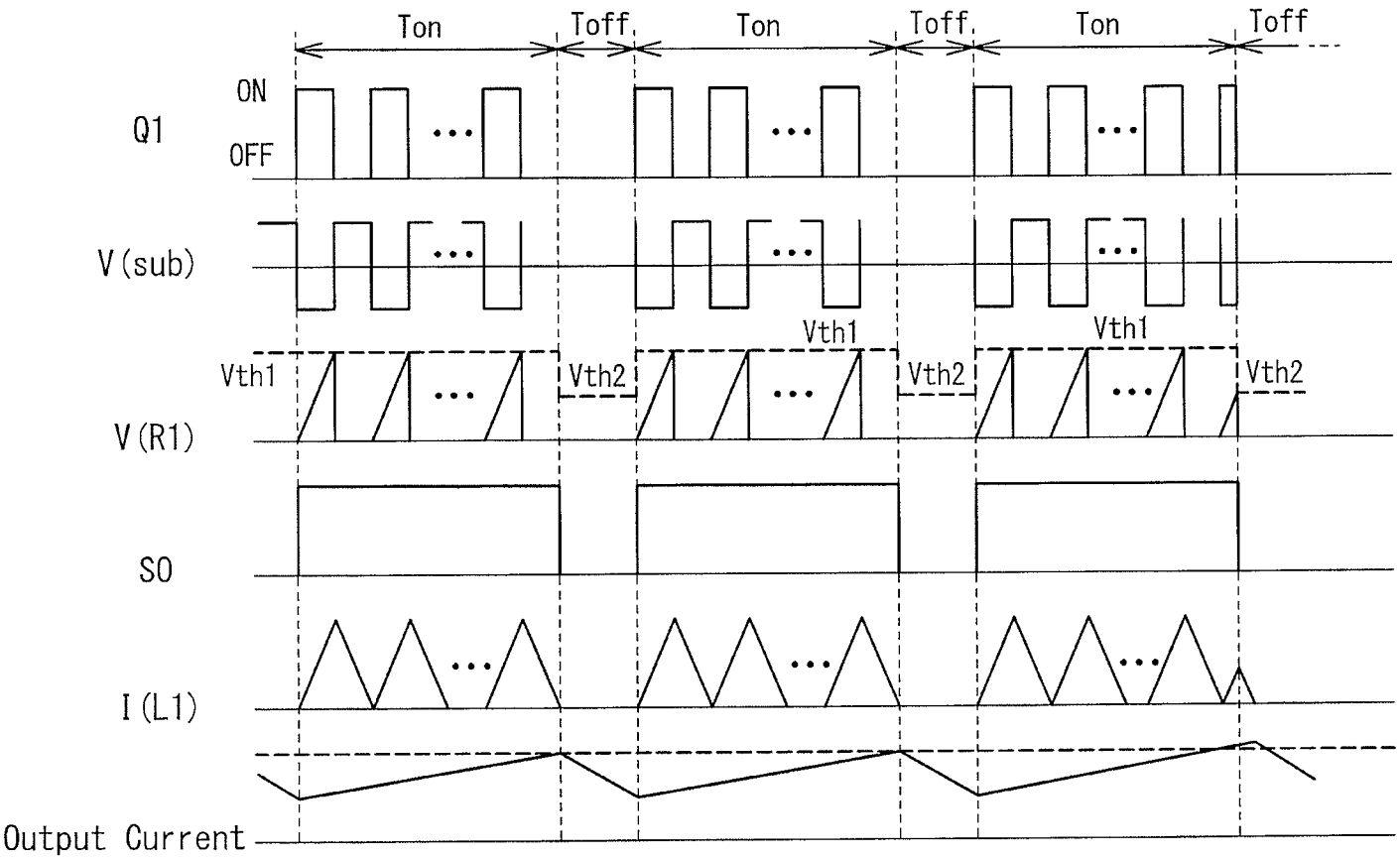
FIG. 2 is a timing chart illustrating an operation of the lighting device.

In view of this circumstance, in the embodiment, the peak current detector 21 is configured to reduce the threshold from a first threshold Vth1 to a second threshold Vth2 (Vth2<Vth1) while the synchronization signal S0 is low, and to increase the threshold so as to be an original value Vth1 while the synchronization signal S0 is high (see FIG. 2). That is, in the embodiment, the peak current detector 21 is configured to reduce the threshold at a finish point of each on-period Ton of the synchronization signal S0, and to increase the threshold so as to be the original value at a start point of each on-period Ton of the synchronization signal S0. If an on-period Ton of the synchronization signal S0 finishes while the switching device Q1 is turned on, an off-timing of the switching device Q1 can be advanced since the threshold is reduced from "Vth1" to "Vth2", in comparison with a case where the threshold is fixed. Accordingly, the fluctuation in the amount of DC power supplied to the light source unit 3 per one period of the synchronization signal S0 can be suppressed, and as a result it is possible to perform dimming control at a low dimming level while the fluctuation in the light intensity can be suppressed.

As described above, the lighting device of the embodiment includes: the power converter 1 configured to convert an input power into a DC power required for the light source unit 3 as a load, where the light source unit 3 includes a solid-state light emitting device as a light source; and the controller 2 configured to control the power converter 1 such that the light source unit 3 is supplied with the DC power of which value is adjusted to a value corresponding to a dimming level designated from the outside. The power converter 1 is formed of a switching regulator that includes: the smoothing capacitor C1 configured to be connected in parallel to the light source unit 3; the inductor L1 connected in series to the smoothing capacitor C1; and the switching device Q1 configured to alternately switch between a state of magnetic energy being accumulated in the inductor L1 by a current flowing through the inductor L1 and a state of the magnetic energy accumulated in the inductor L1 being discharged as a current. The controller 2 includes: the peak current detector 21 configured to output a peak detection signal S1 when detecting that a detection value of the current flowing through the switching device Q1 reaches a threshold while the switching device Q1 is turned on; the zero-cross detector 22 configured to output a zero-cross detection signal S2 when a value of the current discharged from the inductor L1 reaches a predetermined lower limit value or less; the synchronization signal controller 23 configured to output a synchronization signal S0 having a period and an on-time period in accordance with the dimming level; and the switching controller 20 configured to start performing switching of the switching device Q1 in synchronization with a rising edge of the synchronization signal S0, and to stop performing the switching of the switching device Q1 in synchronization with a falling edge of the synchronization signal S0. The switching controller 20 is configured to turn on the switching device Q1 in synchronization with the rising edge of the synchronization signal S0 and the zero-cross detection signal S2, and to turn off the switching device Q1 in synchronization with the peak detection signal S1. The peak current detector 21 is configured to reduce the threshold while the synchronization signal S0 is low, and to increase the threshold so as to be an original value while the synchronization signal S0 is high.

Figure 3:
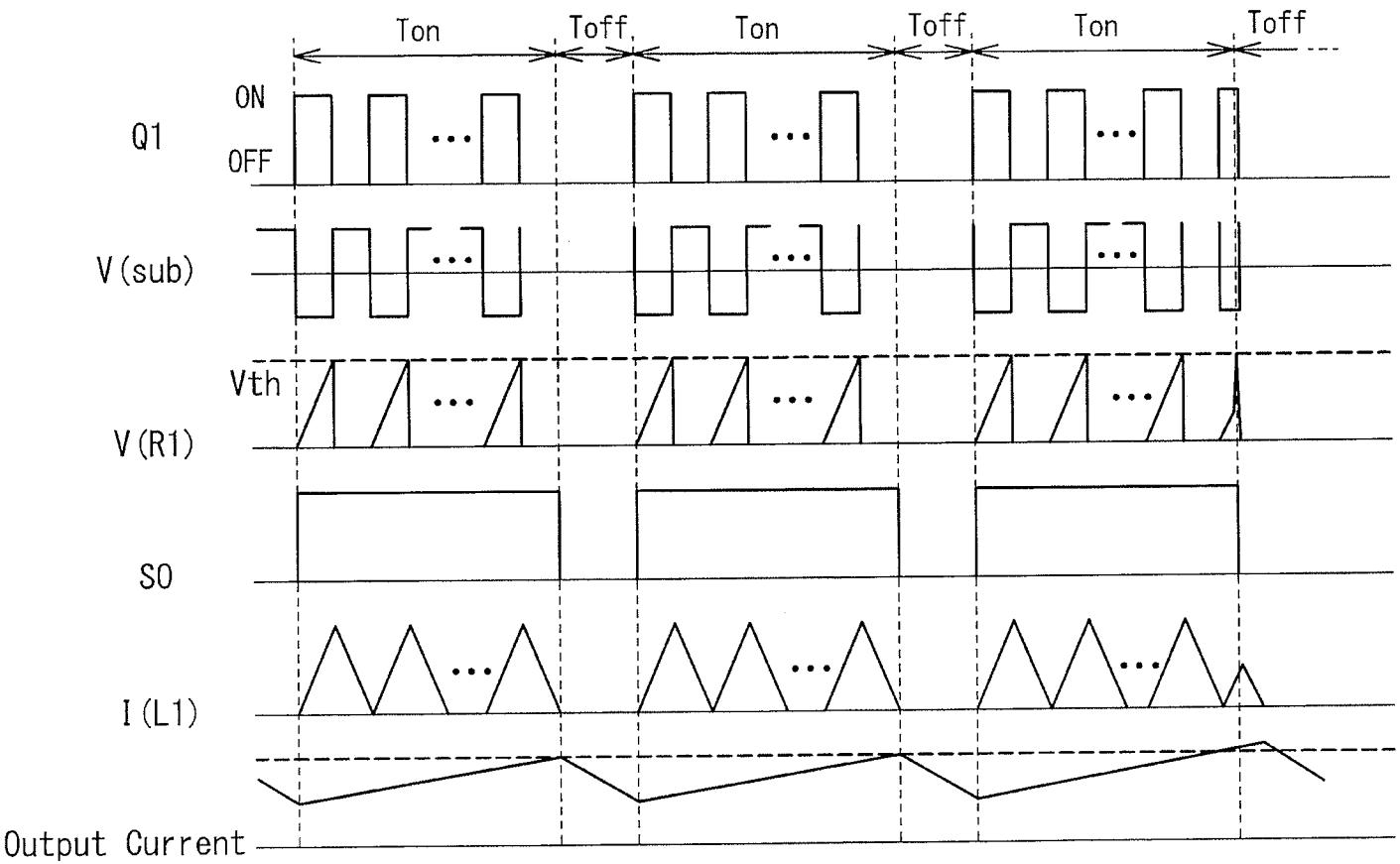
FIG. 3 is a timing chart illustrating an operation of the lighting device.

A peak current detector 21 may be configured to relatively reduce and increase a threshold Vth by increasing and decreasing a detection value (a detected voltage V(R1)) (see FIG. 3). For example, the detected voltage V(R1) may be amplified by an amplifier during off-periods Toff of a synchronization signal S0. Alternatively, one or more auxiliary resistors may be connected in parallel to a detection resistor R1 through a switch(s), which is(are) configured to be turned on during on-periods Ton of the synchronization signal S0 and to be turned off during off-periods Toff of the synchronization signal S0.

It is also possible that a switching controller 20 is configured to perform switching of a switching device Q1 during each off-period Toff of a synchronization signal S0 and be prohibited from performing the switching of the switching device Q1 during each on-period Ton of the synchronization signal SO. In this case, the switching controller 20 is configured, during each off-period Toff of the synchronization signal S0, to turn on the switching device Q1 in synchronization with a rising edge of the synchronization signal S0 and the zero-cross detection signal S2 (a rising edge of the zero-cross detection signal S2), and to turn off the switching device Q1 in synchronization with the peak detection signal S1 (a rising edge of the peak detection signal S1).

That is, a controller 2 may include: a peak current detector 21 configured to output a peak detection signal Si when detecting that a detection value of a current flowing through a switching device Q1 reaches a threshold while the switching device Q1 is turned on; a zero-cross detector 22 configured to output a zero-cross detection signal S2 when a value of the current discharged from an inductor L1 reaches a predetermined lower limit value or less; a synchronization signal controller 23 configured to output a synchronization signal S0 which is a periodic signal having a first period and a second period and a ratio of the first period is adjusted in response to a dimming level; and a switching controller 20 configured to control the switching device Q1 so as to start performing switching of the switching device Q1 at a start point of each first period of the synchronization signal S0, and to stop performing the switching of the switching device Q1 at a finish point of each first period of the synchronization signal S0. The switching controller 20 is configured to turn on the switching device Q1 in synchronization with a start point of each first period of the synchronization signal S0 and the zero-cross detection signal S2, and to turn off the switching device Q1 in synchronization with the peak detection signal S1. The peak current detector 21 is configured to reduce the threshold at a finish point of each first period of the synchronization signal S0, and to increase the threshold so as to be an original value at a start point of each first period (a finish point of each second period) of the synchronization signal S0.

Hereinafter, luminaires according to the embodiments of the invention is explained.

Figure 5A:
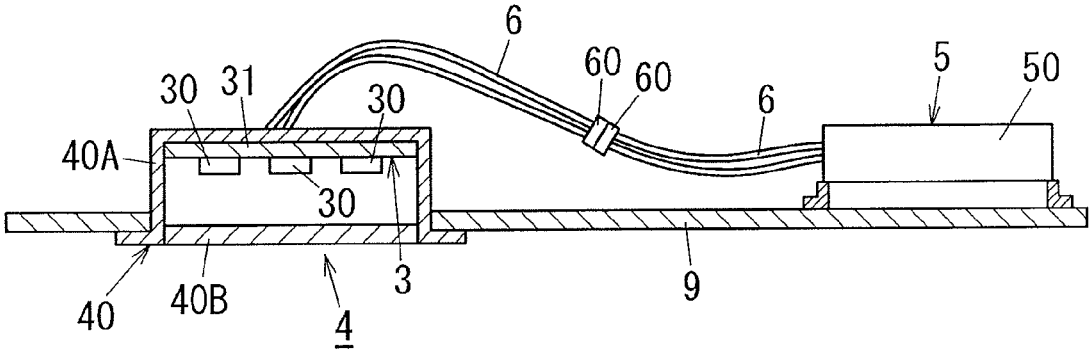
FIGS. 5A and 5B are sectional views of luminaires according to embodiments of the invention.

As shown in FIG. 5A, a luminaire includes a light source device 4, a power supply unit 5 and cables 6 connecting between the light source device 4 and the power supply unit 5. The light source device 4 includes a light source unit 3 in which two or more LEDs 30 are mounted on a substrate 31 shaped like a circular plate, and a housing 40 which is shaped like a circular tube and in which the light source unit 3 is housed. The power supply unit 5 includes a case 50 which is shaped like a box and in which the lighting device is housed. The housing 40 includes a body 40A shaped like a cylinder having a top base and a flange provided at an opening end side thereof, and a cover 40B which is formed of optically transparent material and is shaped like a circular plate so as to close the opening of the body 40A. The housing 40 is embedded in an embedding-hole formed in a ceiling 9. A cable 6 is pulled out from a center of the base of the body 40A, and a connector 60 is provided at an end of the cable 6. The power supply unit 5 is installed in a ceiling. A cable 6 is pulled out from the power supply unit 5, and is provided, at an end thereof, with a connector 60 which is to be connected to the connector 60 provided at the end of the cable 6 pulled out from the light source device 4. The housing 40 and the case 50 form a luminaire body.

Figure 5B:
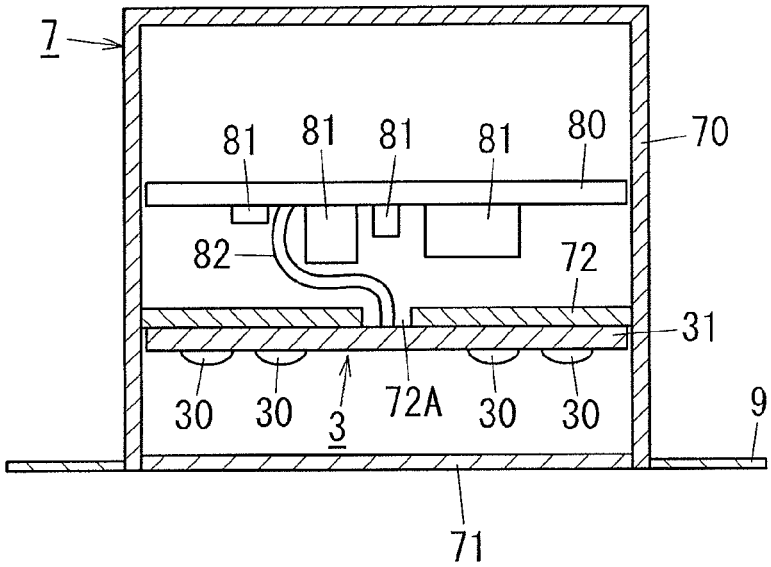

FIG. 5B shows a luminaire according to another embodiment. The luminaire is characterized in that a light source unit 3 and a lighting device is housed in one housing 7. The housing 7 includes a luminaire body 70 which is shaped like a cylinder having a top base and is embedded in a ceiling 9, and a cover 71 which is formed of optically transparent material and is shaped like a circular plate so as to close an opening of the luminaire body 70. An attachment plate 72 is further provided in the luminaire body 70 so as to be opposite face-to-face the cover 71, and the light source unit 3 is attached at a lower surface side of the attachment plate 72. The lighting device includes a printed circuit board 80 shaped like a circular plate and circuit components 81 which are mounted on the printed circuit board 80 and function as a power converter 1, a controller 2, and the like, and is disposed between the base of the luminaire body 70 and the light source unit 3. An electric wire 82 is pulled out from the printed circuit board 80, and is connected to the light source unit 3 through an insertion hole 72A which is opened in a center of the attachment plate 72.

The invention claimed is:

1. A lighting device comprising:

a power converter configured to convert an input power into a DC power required for a light source unit as a load, the light source unit comprising a solid-state light emitting device as a light source; and a controller configured to control the power converter such that the light source unit is supplied with the DC power of which value is adjusted to a value corresponding to a dimming level designated from an outside, wherein the power converter is formed of a switching regulator that comprises:

a smoothing capacitor configured to be connected in parallel to the light source unit;

an inductor connected in series to the smoothing capacitor; and a switching device configured to alternately switch between a state of magnetic energy being accumulated in the inductor by a current flowing through the inductor and a state of the magnetic energy accumulated in the inductor being discharged as a current, the controller comprises:

a peak current detector configured to output a peak detection signal when detecting that a detection value of the current flowing through the switching device reaches a threshold while the switching device is turned on;

a zero-cross detector configured to output a zero-cross detection signal when a value of the current discharged from the inductor reaches a predetermined lower limit value or less;

a synchronization signal controller configured to output a synchronization signal having a period and an on-time period in accordance with the dimming level; and a switching controller configured to start performing switching of the switching device in synchronization with a rising edge of the synchronization signal, and to stop performing the switching of the switching device in synchronization with a falling edge of the synchronization signal, the switching controller is configured to turn on the switching device in synchronization with the rising edge of the synchronization signal and the zero-cross detection signal, and to turn off the switching device in synchronization with the peak detection signal, and the peak current detector is configured to reduce the threshold while the synchronization signal is low, and to increase the threshold so as to be an original value while the synchronization signal is high.

2. The lighting device according to claim 1, wherein the peak current detector is configured to relatively reduce and increase the threshold by increasing and decreasing the detection value.

3. A luminaire comprising:

the lighting device according to claim 2;

the light source unit comprising the solid-state light emitting device as the light source; and a luminaire body that holds the light source unit and the lighting device.

4. A luminaire comprising:

the lighting device according to claim 1;

the light source unit comprising the solid-state light emitting device as the light source; and a luminaire body that holds the light source unit and the lighting device.

* * * * *